US011126119B2

(12) United States Patent
Takahashi et al.

(10) Patent No.: US 11,126,119 B2
(45) Date of Patent: Sep. 21, 2021

(54) FIXING DEVICE INCLUDING HEATER HOLDING MEMBER THAT HOLDS HEATER FOR HEATING BELT

(71) Applicant: KYOCERA Document Solutions Inc., Osaka (JP)

(72) Inventors: Hironori Takahashi, Osaka (JP); Masakazu Uehara, Osaka (JP); Tomohiro Watatani, Osaka (JP); Yuhiro Sakai, Osaka (JP); Fumito Nakamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/887,278

(22) Filed: May 29, 2020

(65) Prior Publication Data

US 2020/0379388 A1 Dec. 3, 2020

(30) Foreign Application Priority Data

May 31, 2019 (JP) ..... JP2019-102281
May 31, 2019 (JP) ..... JP2019-102355

(51) Int. Cl.
*G03G 15/20* (2006.01)

(52) U.S. Cl.
CPC ..... *G03G 15/2053* (2013.01); *G03G 15/206* (2013.01); *G03G 15/2064* (2013.01); *G03G 2215/2035* (2013.01)

(58) Field of Classification Search
CPC ..... G03G 15/2053; G03G 15/2064; G03G 15/206; G03G 2215/2035; G03G 2215/2016; G03G 2215/2029
See application file for complete search history.

(56) References Cited

U.S. PATENT DOCUMENTS 6,040,558 A * 3/2000 Yamazaki ..... G03G 15/2064 219/216
9,423,732 B2 * 8/2016 Tsunashima ..... G03G 15/2053
2011/0044734 A1 * 2/2011 Shimokawa ..... G03G 15/2053 399/322
2011/0229228 A1 * 9/2011 Yoshikawa ..... G03G 15/2039 399/329
2012/0148303 A1 * 6/2012 Yamaguchi ..... G03G 15/2053 399/122

(Continued)

FOREIGN PATENT DOCUMENTS

JP 2017-097143 A 6/2017

*Primary Examiner* — Walter L Lindsay, Jr.
*Assistant Examiner* — Laura Roth
(74) *Attorney, Agent, or Firm* — Studebaker & Brackett PC

(57) ABSTRACT

A fixing device includes a fixing belt, a pressure member, a first holding member, and a second holding member. The fixing belt is endless and includes a first rim and a second rim. The pressure member presses the fixing belt by being in contact with an outer circumferential surface of the fixing belt and rotates about a rotation axis of the pressure member. The first holding member is attached to the fixing belt and holds the first rim of the fixing belt. The second holding member is attached to the fixing belt and holds the second rim of the fixing belt. The second holding member includes a base portion, a main portion, and a protrusion. The main portion protrudes from the base portion. The protrusion protrudes from the main portion in a direction away from the base portion.

12 Claims, 12 Drawing Sheets

(56) References Cited

U.S. PATENT DOCUMENTS

| | | | | |
|---|---|---|---|---|
| 2012/0155935 | A1* | 6/2012 | Yoshikawa | G03G 15/2053 399/329 |
| 2013/0045032 | A1* | 2/2013 | Shimokawa | G03G 15/2053 399/329 |
| 2013/0071158 | A1* | 3/2013 | Suzuki | G03G 15/2053 399/329 |
| 2015/0104227 | A1* | 4/2015 | Shimokawa | G03G 15/2053 399/329 |
| 2016/0363891 | A1* | 12/2016 | Lee | G03G 15/2053 |
| 2017/0031279 | A1* | 2/2017 | Koyama | G03G 15/2046 |

* cited by examiner

FIXING DEVICE INCLUDING HEATER HOLDING MEMBER THAT HOLDS HEATER FOR HEATING BELT

INCORPORATION BY REFERENCE

The present application claims priority under 35 U.S.C. § 119 to Japanese Patent Application Nos. 2019-102281 and 2019-102355, each filed on May 31, 2019. The contents of these applications are incorporated herein by reference in their entirety.

BACKGROUND

The present disclosure relates to a fixing device and an image forming apparatus.

Fixing devices using a heating film are known as one type of fixing device included in electrophotographic image forming apparatuses. Such a fixing device includes a fixing assembly and a pressure roller pressing against the fixing assembly to form a nip part. The fixing assembly includes a cylindrical fixing film (fixing belt), a heater in contact with an inner surface of the fixing film, a heat insulating holder that holds the heater, a metal stay that presses the heat insulating holder against the pressure roller, a thermistor, and a heat conductive member.

SUMMARY

A fixing device according to an aspect of the present disclosure includes a fixing belt, a pressure member, a first holding member, and a second holding member. The fixing belt is endless and includes a first rim and a second rim. The pressure member presses the fixing belt by being in contact with an outer circumferential surface of the fixing belt and rotates about a rotation axis of the pressure member. The first holding member is attached to the fixing belt and holds the first rim of the fixing belt. The second holding member is attached to the fixing belt and holds the second rim of the fixing belt. The second holding member includes a base portion, a main portion, and a protrusion. The main portion protrudes from the base portion. The protrusion protrudes from the main portion in a direction away from the base portion.

An image forming apparatus according to an aspect of the present disclosure includes the above-described fixing device and an image forming section. The image forming section forms a toner image on a recording medium. The fixing device fixes the toner image to the recording medium.

A fixing device according to another aspect of the present disclosure includes a fixing belt, a present disclosure, and a heating section. The fixing belt is endless. The pressure member presses the fixing belt by being in contact with an outer circumferential surface of the fixing belt and rotates about a rotation axis of the pressure member. The heating section is disposed opposite to an inner circumferential surface of the fixing belt. The heating section includes a heater and a heater holding member. The heater extends in an axial direction thereof that is parallel to an axial direction of the fixing belt and heats the fixing belt. The axial direction of the fixing belt is parallel to the rotation axis of the pressure member. The heater holding member extends in parallel to the axial direction and holds the heater. The heater holding member includes side walls in a pair and a bottom wall located opposite to the heater. Each of the side walls includes a distal end and a main body portion continuing to the distal end. A first distance between tip edges of the distal ends is shorter than an inner diameter of the fixing belt when the fixing belt is in a circular shape in cross section. A second distance between outer peripheral extremities of the main body portions is longer than the inner diameter of the fixing belt when the fixing belt is in the circular shape in cross section.

An image forming apparatus according to another aspect of the present disclosure includes the above-described fixing devices and an image forming section. The image forming section forms a toner image on a recording medium. The fixing device fixes the toner image to the sheet.

DETAILED DESCRIPTION

Figure 1:
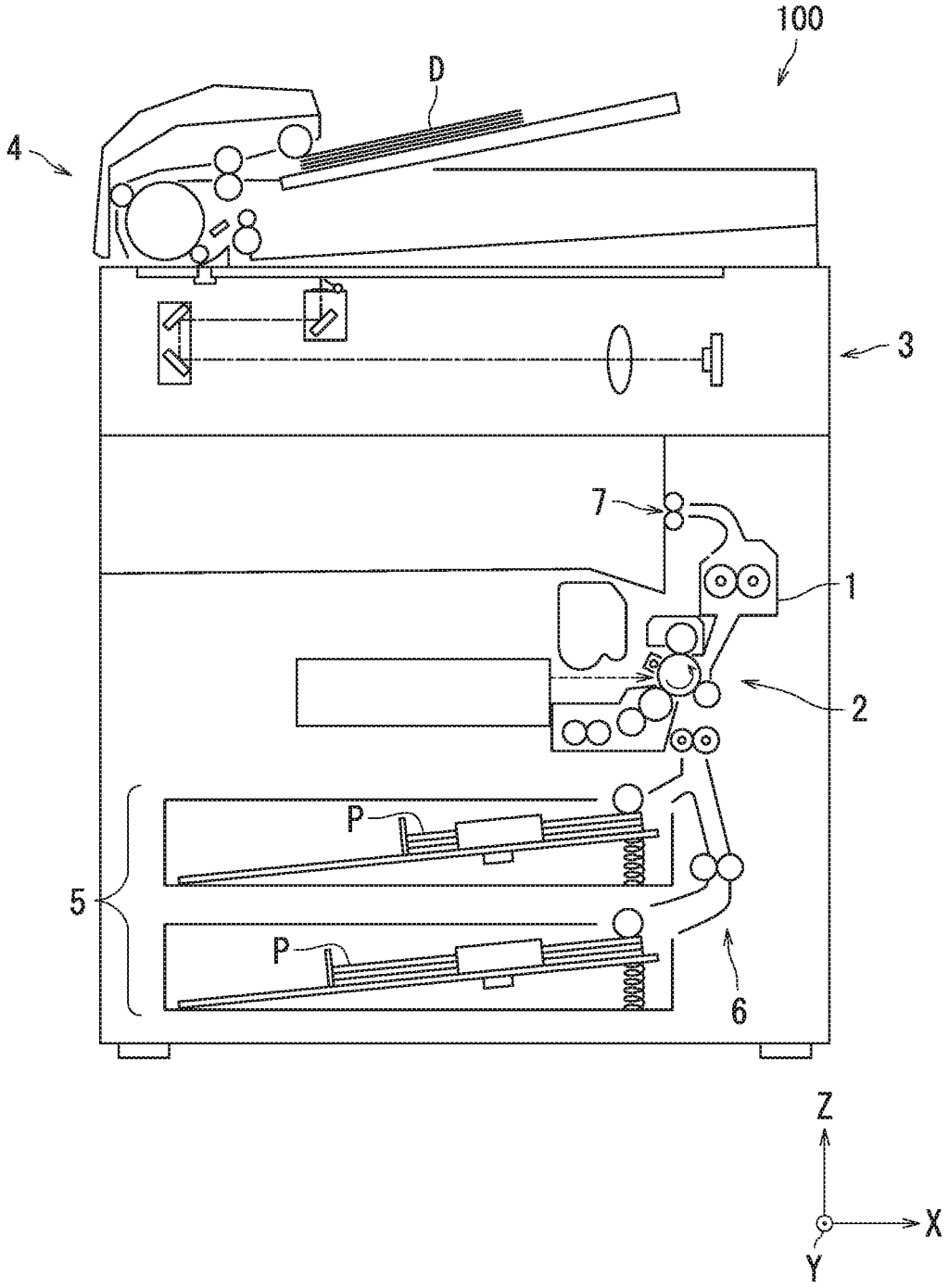
FIG. 1 is a diagram illustrating an image forming apparatus including a fixing device according to an embodiment of the present disclosure.

The following describes an embodiment of the present disclosure with reference to the accompanying drawings. Note that elements that are the same or equivalent are indicated by the same reference signs in the drawings and description thereof is not repeated. In the present embodiment, an X axis, a Y axis, and a Z axis that are perpendicular to one another are indicated in each drawing. The Z axis is parallel to a vertical plane, and the X axis and the Y axis are parallel to a horizontal plane.

An image forming apparatus 100 according to an embodiment of the present disclosure will be described below with reference to FIG. 1. FIG. 1 is a diagram illustrating the image forming apparatus 100 including a fixing device 1 according to the present embodiment. The image forming apparatus 100 is for example a copier, a facsimile machine, or a multifunction peripheral having functions of these machines. In the present embodiment, the image forming apparatus 100 is a monochrome multifunction peripheral.

As illustrated in FIG. 1, the image forming apparatus 100 includes a reading section 3, a document conveyance section 4, a sheet feed section 5, a conveyance section 6, an image forming section 2, the fixing device 1, and an ejection section 7.

The reading section 3 reads an image of a document D. The reading section 3 generates image data from the read image. The document conveyance section 4 conveys the document D to the reading section 3. The sheet feed section 5 accommodates a plurality of sheets P and feeds the sheets P to the conveyance section 6 on a sheet-by sheet basis. Each sheet P is made from for example paper or synthetic resin. The sheet P is an example of a recording medium. The conveyance section 6 includes a plurality of conveyance roller pairs, and conveys the sheet P to the ejection section 7 via the image forming section 2.

The image forming section 2 electrographically forms a toner image on the sheet P based on the image data. The image data represents for example the image of the document D. The image forming section 2 includes for example a photosensitive drum, a charger, a light exposure device, a development device, a replenishment device, a transfer roller, a cleaner, and a static eliminator.

The fixing device 1 fixes the toner image to the sheet P by applying heat and pressure to the toner image. The conveyance section 6 conveys the sheet P with the toner image fixed thereto to the ejection section 7. The ejection section 7 ejects the sheet P out of the casing of the image forming apparatus 100.

Figure 2:
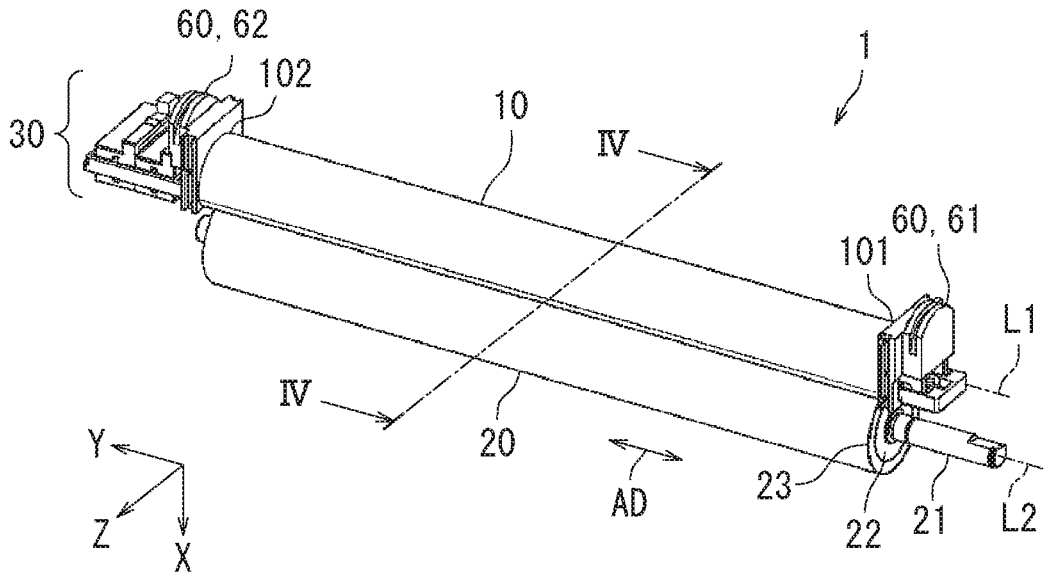
FIG. 2 is a perspective view of main components of the fixing device according to the embodiment.

A configuration of the fixing device 1 according to the present embodiment will be described next in detail with reference to FIGS. 2 to 4. FIG. 2 is a perspective view of main components of the fixing device 1 according to the present embodiment. As illustrated in FIG. 2, the fixing device 1 includes a fixing belt 10, a pressure member 20, a heating section 30, and belt holding members 60.

The heating section 30 heats the fixing belt 10. The fixing belt 10 heated by the heating section 30 heats the sheet P to which the toner image has been transferred. The fixing belt 10 is endless. The fixing belt 10 has a substantially cylindrical shape. The fixing belt 10 is flexible. The fixing belt 10 is rotatable about a first rotation axis L1 thereof as an axial center. The fixing belt 10 extends in a direction of the first rotation axis L1. In other words, the fixing belt 10 extends in an axial direction AD that is parallel to the first rotation axis L. The fixing belt 10 has a first rim 101 and a second rim 102.

The first rim 101 and the second rim 102 each are an end of the fixing belt 10 in the direction of the first rotation axis L1. That is, the first rim 101 and the second rim 102 are opposite ends of the fixing belt 10 that extends in the axial direction AD. Hereinafter, the direction of the first rotation axis L1 may be referred to as a "width direction of the fixing belt 10".

The respective belt holding members 60 are attached to the first rim 101 and the second rim 102. The respective belt holding members 60 for the fixing belt 10 hold the first rim 101 and the second rim 102 of the fixing belt 10. In the present embodiment, the belt holding members 60 include a first holding member 61 and a second holding member 62. The first holding member 61 holds the first rim 101 of the fixing belt 10. The second holding member 62 holds the second rim 102 of the fixing belt 10. At least one of the first rim 101 and the second rim 102 of the fixing belt 10 is equivalent to an example of a"rim of the fixing belt".

The pressure member 20 is for example a pressure roller. The pressure member 20 extends along a second rotation axis L2 of the pressure member. The pressure member 20 includes a columnar metal core 21, a cylindrical elastic layer 22, and a release layer 23. The elastic layer 22 is formed around the metal core 21. The release layer 23 covers a surface of the elastic layer 22. The metal core 21 is rotatable about the second rotation axis L2 as an axial center. The metal core 21 is made from for example stainless steel or aluminum. The elastic layer 22 is elastic and made from for example silicone rubber. The release layer 23 is made from for example fluororesin. Note that the second rotation axis L2 is substantially parallel to the first rotation axis L1. The second rotation axis L2 is equivalent to an example of a "rotation axis".

Figure 3:
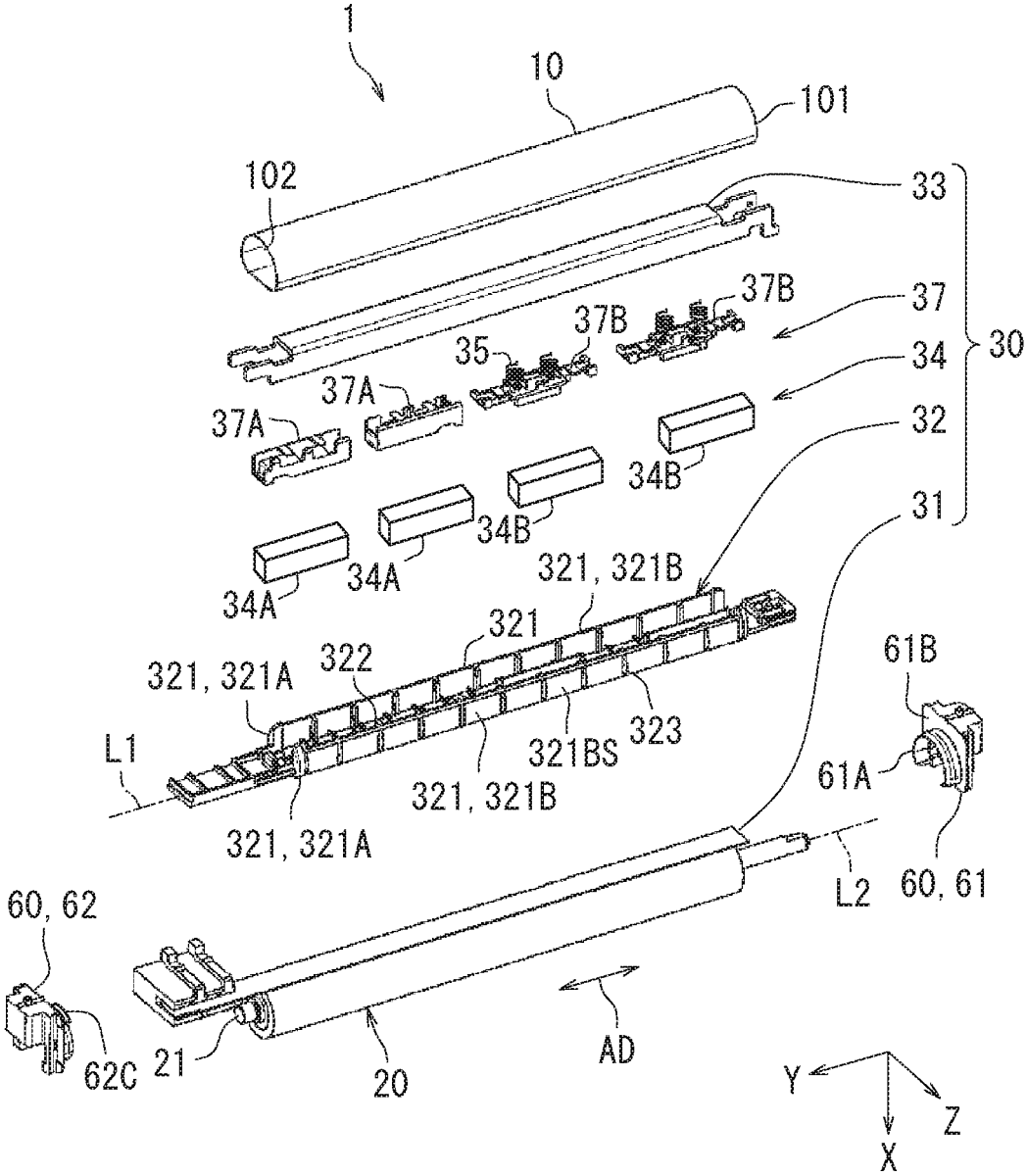
FIG. 3 is an exploded perspective view of the fixing device according to the embodiment.

FIG. 3 is an exploded perspective view of the fixing device 1 according to the present embodiment. As illustrated in FIG. 3, the heating section 30 includes a heater 31, a heater holding member 32, a reinforcing member 33, a plurality of heat sensitive bodies 34, and a plurality of covering members 37.

The heater 31 heats the fixing belt 10. The heater 31 extends in parallel to the first rotation axis L1. Specifically, the heater 31 has a planar shape or a thin and long plate shape. The heater 31 is for example a planar heater or a thin and long plate-shaped heater. The heater 31 is for example a ceramic heater including a ceramic substrate and a resistance heating element. The heater 31 has a thickness of 1 mm, for example.

The heater holding member 32 holds the heater 31. The heater holding member 32 is made from heat resistant resin, for example. The heater holding member 32 extends in parallel to the first rotation axis L1. One of two opposite ends of the heater holding member 32 in terms of the first rotation axis L1 that is close to the second rim 102 of the fixing belt 10 is capable of being directly or indirectly fitted to for example a connecter provided in a main body of the image forming apparatus 100.

The heater holding member 32 includes a pair of side walls 321 and a bottom wall 322 located opposite to the heater 31. Each of the side walls 321 has a distal end 321A and a main body portion 321B. The main body portion 321B continues to the distal end 321A. The main body portion 321B includes a plurality of ribs 323. Each of the ribs 323 protrudes from a main surface 321BS of the main body portion 321B. The ribs 323 are arranged at intervals in parallel to in the axial direction AD. In the present embodiment, the ribs 323 have substantially the same heights as one another. The heights of the ribs 323 are side lengths of the respective ribs 323 in a direction of the Z axis.

The heat sensitive bodies 34 are disposed opposite to the heater 31. The heat sensitive bodies 34 are disposed on the heater holding member 32. For example, a central portion of each of the heat sensitive bodies 34 is inserted into an opening in the heater holding member 32 so as to be adjacent to the heater 31. The heat sensitive bodies 34 each sense heat of the heater 31. The heat sensitive bodies 34 in the present embodiment include first heat sensitive bodies 34A and second heat sensitive bodies 34B.

The heat sensitive bodies 34 include at least one type of a thermal cutoff, a thermostat, and a thermistor. The thermal cutoff is a protection element such as a one-shot thermostat. The thermal cutoff shuts off electric power supply to the heater 31 when the temperature of the heater 31 is equal to or higher than a threshold. In particular, once the thermal cutoff shuts off electric power supply according to the temperature of the heater 31, electric power supply is not resumed. In the above configuration, heating of the fixing belt 10 by the heater 31 can be more accurately suspended when the temperature of the heater 31 increases excessively.

The thermostat shuts off electric power supply to the heater 31 once the temperature of the heater 31 is equal to or higher than a threshold, and allows resumption of electric power supply to the heater 31 when the temperature of the heater 31 becomes lower than the threshold. In the above configuration, the heater 31 for heating the fixing belt 10 can be turned on and off with delicate accuracy corresponding to change in temperature of the heater 31.

The thermistor is a semiconductor element for measuring the temperature of the heater 31. The image forming apparatus 100 controls the heater 31 according to a temperature measured by the thermistor. As a result of the heat sensitive bodies 34 each being a thermistor, accuracy in temperature control on the heater 31 can be increased.

The covering members 37 are disposed opposite to the heater holding member 32 with the respective heat sensitive bodies 34 therebetween. Specifically, the covering members 37 are overlaid with the heater 31, the heater holding member 32, and the heat sensitive bodies 34 in a direction intersecting with the axial direction AD. In the present embodiment, the covering members 37 are overlaid with the heater 31, the heater holding member 32, and the respective heat sensitive bodies 34 in a direction of the X axis. The covering members 37 each are a resin-made box member having heat resistance, for example. Each of the covering members 37 covers at least part of a corresponding one of the heat sensitive bodies 34. In the present embodiment, the covering members 37 include first covering members 37A and second covering members 37B. Specifically, the first covering members 37A each cover at least part of a corresponding one of the first heat sensitive bodies 34A. Also, the second covering members 37B each cover at least part of a corresponding one of the second heat sensitive bodies 34B.

A plurality of urging members 35 are fitted to each of the second covering members 37B. Each of the urging members 35 is a coil spring, for example. Each of the urging members 35 has for example a cylindrical shape, a conical shape, or a barrel shape. The urging members 35 are arranged at intervals in a direction parallel to the axial direction AD. In the present embodiment, two urging members 35 are fitted to each of the second covering members 37B. Each pair of urging members 35 urges a corresponding one of the second heat sensitive bodies 34B with a corresponding one of the second covering members 37B therebetween. The above configuration can allow urging force of the urging members 35 to more accurately act on the second heat sensitive bodies 34B. Thus, precision in sensitivity of the second heat sensitive bodies 34B to the temperature of the heater 31 can be further increased.

The reinforcing member 33 reinforces the heater holding member 32. The reinforcing member 33 is for example a slim and long metal stay member. The reinforcing member 33 has a substantially inverted U-shape in cross section as viewed in a direction parallel to the axial direction AD. The reinforcing member 33 extends in a direction parallel to the axial direction AD. The reinforcing member 33 is secured to a location opposite to the heater holding member 32.

An inner circumferential surface 104 of the fixing belt 10 is urged by the heater holding member 32 through insertion of the heating section 30 in the fixing belt 10. Specifically, the inner circumferential surface 104 of the fixing belt 10 is urged by the ribs 323 of the heater holding member 32 through insertion of the heating section 30 in the fixing belt 10. When the inner circumferential surface 104 of the fixing belt 10 is urged by the ribs 323 (the heater holding member 32), the fixing belt 10 is in a non-circular shape. The non-circular shape in the present embodiment means a shape that includes a straight line and an ark.

Figure 4:
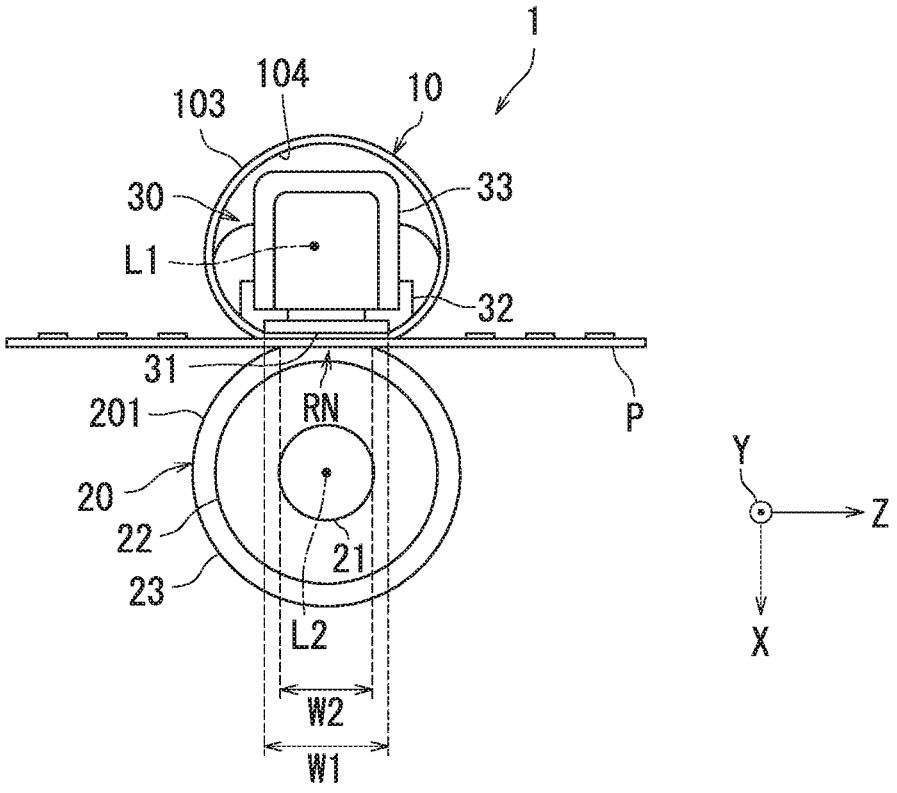
FIG. 4 is a transverse cross-sectional view taken along a line IV-IV in FIG. 2.

FIG. 4 is a transverse cross-sectional view taken along a line IV-IV in FIG. 2. Note that some components inside the fixing belt 10 are omitted in FIG. 4 in order to facilitate understanding. As illustrated in FIG. 4, the fixing belt 10 further has an outer circumferential surface 103 and an inner circumferential surface 104. Also, the pressure member 20 has an outer circumferential surface 201. The outer circumferential surface 103 of the fixing belt 10 is in contact with the outer circumferential surface 201 of the pressure member 20 when no sheet P is present in a fixing nip area RN. Note that the outer circumferential surface 103 faces the outer circumferential surface 201 with the sheet P therebetween in FIG. 4.

The fixing belt 10 includes a plurality of layers. The fixing belt 10 includes for example a polyimide layer and a release layer. The release layer is located around an outer circumferential surface of the polyimide layer. The release layer is a heat-resistant film made from fluororesin, for example.

The inner circumferential surface 104 of the fixing belt 10 faces the heating section 30. In other words, the heating section 30 is disposed in an inner space of the fixing belt 10. Specifically, the heater holding member 32 of the heating section 30 is disposed inside the fixing belt 10 on a side close to the pressure member 20. The heater holding member 32 is located opposite to the fixing belt 10 with the heater 31 therebetween. The heater 31 receives pressure from the pressure member 20 through the fixing belt 10. The heater 31 receives pressure from the reinforcing member 33 through the heater holding member 32.

The pressure member 20 presses the fixing belt 10 and the sheet P with the toner image transferred thereto. Specifically, the pressure member 20 has a substantially columnar shape and is disposed opposite to the fixing belt 10. The pressure member 20 is pressed against the fixing belt 10. In other words, the pressure member 20 presses the fixing belt 10. In the above configuration, the outer circumferential surface 201 of the pressure member 20 is in contact with the outer circumferential surface 103 of the fixing belt 10 to form the fixing nip area RN. That is, the fixing nip area RN is formed by the outer circumferential surface 103 of the fixing belt 10 and the outer circumferential surface 201 of the pressure member 20 being in contact with each other.

The pressure member 20 is rotatable about the second rotation axis L2 as an axial center. When the pressure member 20 rotates, the fixing belt 10 rotates following the rotation of the pressure member 20. With the above configuration, the toner image is fixed to the sheet P through the sheet P passing through the fixing nip area RN. Note that the sheet P is conveyed in a sheet conveyance direction (positive direction of the Z axis). In the present embodiment, a first width W1 of the heater 31 in terms of the sheet conveyance direction is larger than a second width W2 of the fixing nip area RN in terms of the sheet conveyance direction. That is, the first width W1 of the heater 31 in a short direction of the heater 31 is larger than the second width W2 of the fixing nip area RN in a short direction of the fixing nip area RN. In the above configuration, a situation in which a corner edge of the heater 31 bites into the fixing belt 10 through the pressure member 20 pressing the fixing belt 10 can be prevented. Thus, breakage of the fixing belt 10 can be prevented.

Figure 5:
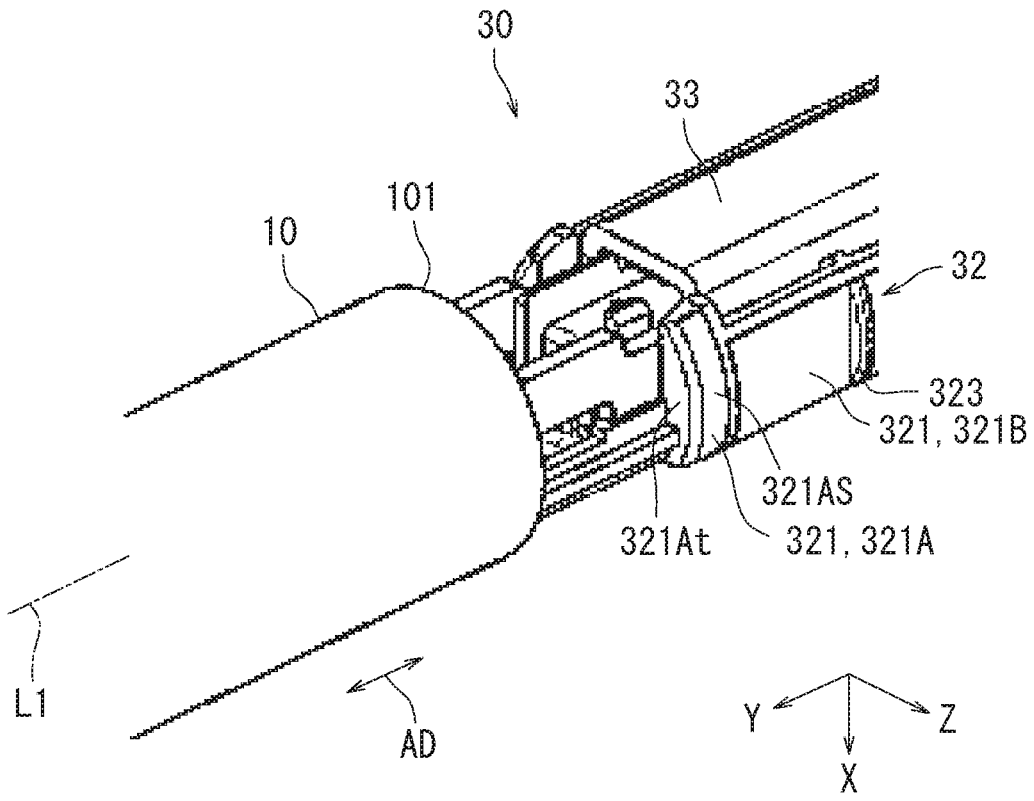
FIG. 5 is a perspective view of a portion of a heating section in the embodiment.

The heater holding member 32 in the present embodiment will be described next with reference to FIG. 5. FIG. 5 is a perspective view of part of the heating section 30 in the present embodiment. Specifically. FIG. 5 illustrates the distal end 321A of one of the side walls 321 of the heater holding member 32 of the heating section 30. Furthermore, FIG. 5 illustrates a state before the heating section 30 is inserted in the fixing belt 10. As illustrated in FIG. 5, each distal end 321A has an outer surface 321AS that curves as viewed in a direction parallel to the axial direction AD. The fixing belt 10 is substantially in a circular shape in cross section before the heating section 30 is inserted in the fixing belt 10.

Figure 6:
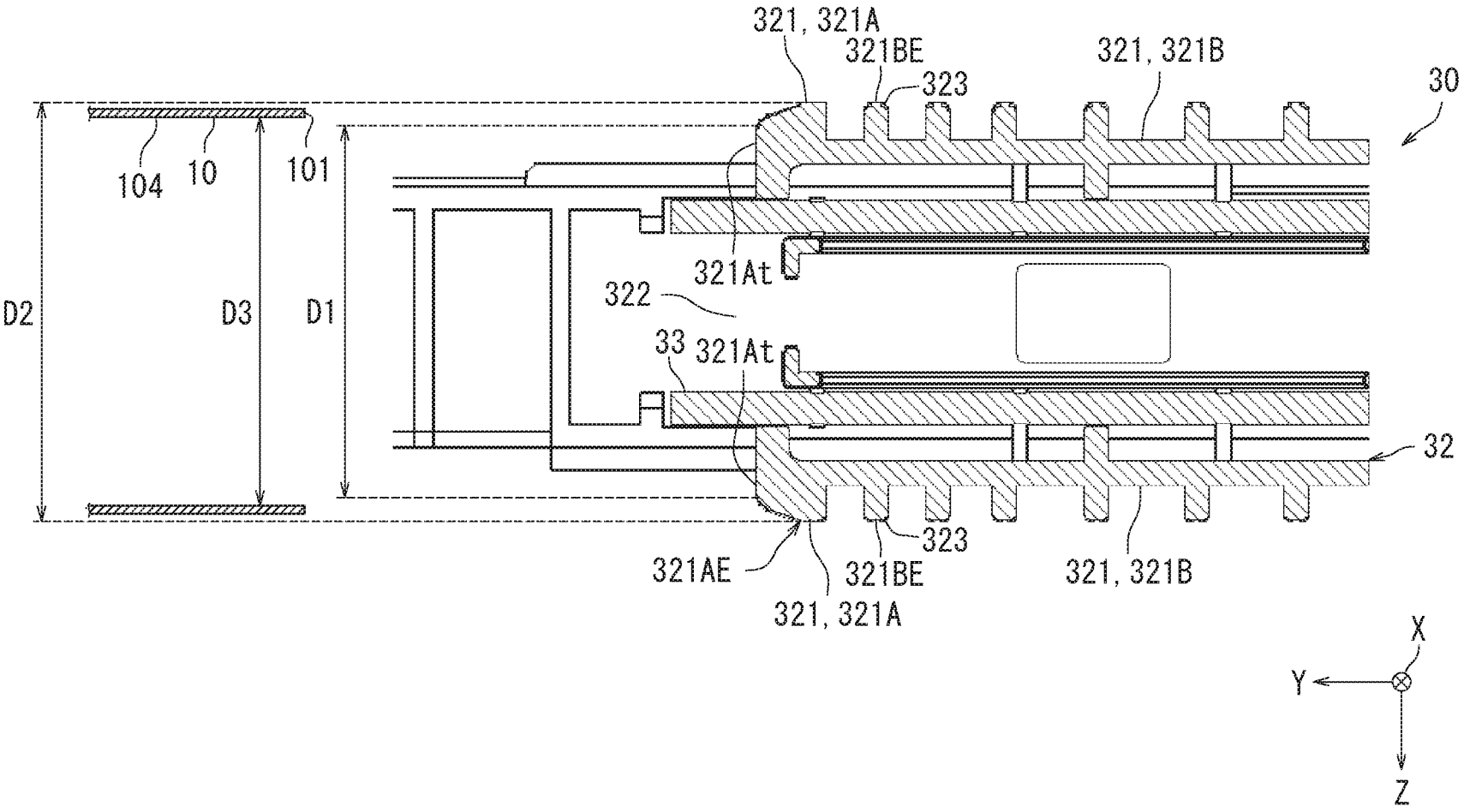
FIG. 6 is a vertical cross-sectional view of a fixing belt and the heating section in the embodiment.

FIG. 6 is a cross-sectional view of the fixing belt 10 and the heating section 30. Specifically, FIG. 6 is a vertical cross-sectional view of the vicinity of the distal ends 321A of the heater holding member 32. Note that FIG. 6 illustrates a cross section of the fixing belt 10 in the width direction thereof as viewed from a negative side of the X axis. Furthermore, FIG. 6 illustrates a state before the heating section 30 is inserted in the fixing belt 10. That is, the fixing belt 10 in FIG. 6 is in a circular shape in cross section.

As illustrated in FIG. 6, a first distance D1 between tip edges 321At of the distal ends 321A in a pair is shorter than a third distance D3 that is an inner diameter of the fixing belt 10 (also referred to below as an inner diameter W4) when the fixing belt 10 is in a circular shape in cross section. In the above configuration, the heating section 30 can be inserted into the fixing belt 10 while the tip edges 321At of the distal ends 321A of the heater holding member 32 are kept out of contact with the first rim 101 of the fixing belt 10. Thus, breakage of the fixing belt 10 can be prevented.

The main body portions 321B each have an outer peripheral extremity 321BE that corresponds to an outer peripheral extremity of each rib 323 protruding from the main body portion 321B in the present embodiment. A second distance D2 between the outer peripheral extremities 321BE of the main body portions 321B in a pair is longer than the third distance D3 that is the inner diameter W4 of the fixing belt 10 when the fixing belt 10 is in a circular shape in cross section. In the above configuration, the inner diameter W4 of the fixing belt 10 can be made equal to the second distance D2 through insertion of the heating section 30 into the fixing belt 10. Thus, a situation in which the corner edge of the heater 31 bites into the fixing belt 10 can be further effectively prevented to further effectively prevent breakage of the fixing belt 10.

The distal ends 321A taper toward the tip edges 321At of the respective distal ends 321A. Specifically, the first distance D1 between the tip edges 321At of the distal ends 321A in a pair is shorter than the second distance D2 between outer peripheral extremities 321AE of the distal ends 321A in a pair and shorter than the third distance D3 that is the inner diameter W4 of the fixing belt 10 when the fixing belt 10 is in a circular shape in cross section. In the above configuration, the heating section 30 can be inserted into the fixing belt 10 by gradually inserting the heating section 30 into the fixing belt 10 while keeping the tip edges 321At of the distal ends 321A of the heater holding member 32 out of contact with the first rim 101 of the fixing belt 10. Thus, breakage of the fixing belt 10 can be further effectively prevented.

Furthermore, the distal ends 321A curve and incline so as to expand in diameter from the tip edges 321At of the respective distal ends 321A toward the main body portions 321B. In the above configuration, the fixing belt 10 can be gradually expanded to increase the inner diameter W4 thereof in course of the heating section 30 being inserted into the fixing belt 10. Thus, breakage of the fixing belt 10 can be further effectively prevented.

In the present embodiment, each of the outer surfaces 321AS of the distal ends 321A curves when viewing the distal ends 321A in a direction parallel to the direction of the first rotation axis L1 (see FIG. 5). Specifically, the contour of the outer surface 321AS of each distal end 321A curves when the distal end 321A is viewed in a direction parallel to the direction of the first rotation axis L1. More specifically, the contour of the outer surface 321AS of each distal end 321A has a C-shape in cross section. In the above configuration, a situation in which a corner edge of each distal end 321A of the outer surface 321AS bites into the fixing belt 10 can be further effectively prevented. Thus, breakage of the fixing belt 10 can be further effectively prevented.

Figure 7A:
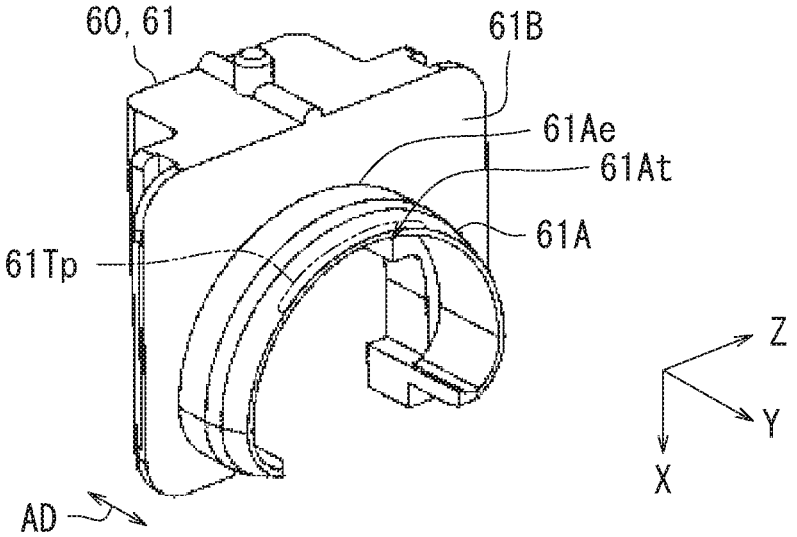
FIG. 7A is a perspective view of a first holding member in the embodiment.
Figure 7B:
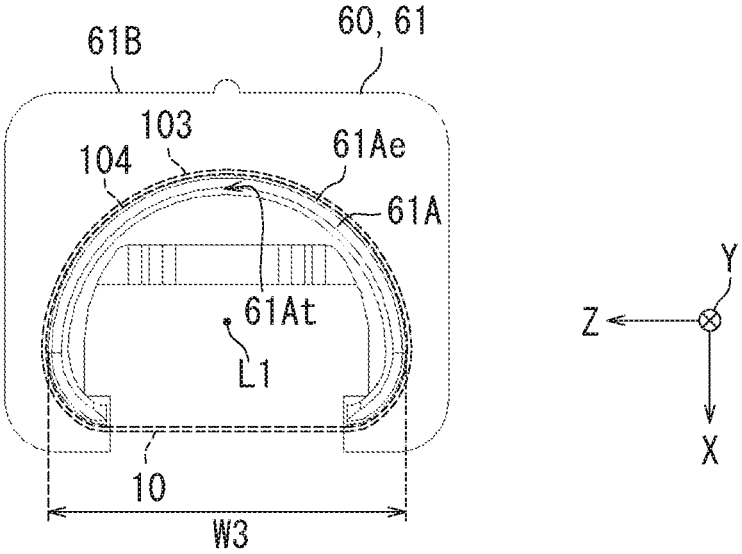
FIG. 7B is a plan view of the first holding member in the embodiment.

The first holding member 61 in the present embodiment will be described next with reference to FIGS. 7A to 7C. FIG. 7A is a perspective view of the first holding member 61 in the present embodiment. FIG. 7B is a plan view of the first holding member 61 attached to the fixing belt 10. The fixing belt 10 is indicated by broken lines in FIG. 7B for the sake of explanation. Note that the first holding member 61 is attached to the fixing belt 10 after the heating section 30 is inserted in the fixing belt 10. The fixing belt 10 is substantially in a non-circular shape in cross section after the heating section 30 is inserted in the fixing belt 10.

As illustrated in FIGS. 7A and 7B, the first holding member 61 includes a main portion 61A and abase portion 61B. The main portion 61A protrudes from the base portion 61B in a direction parallel to the first rotation axis L1. The main portion 61A has an outer circumferential surface with a C-shape in cross section when viewed in a direction parallel the first rotation axis L1. The main portion 61A curves toward a base end 61Ae of the main portion 61A from a tip edge 61At of the main portion 61A. Specifically, the outer peripheral surface of the main portion 61A curves toward the base end 61Ae of the main portion 61A from the tip edge 61At of the main portion 61A. More specifically, the outer circumferential surface of the main portion 61A is a curved surface including a portion on a side of the base end 61Ae and a portion on a side of the tip edge 61At. The portion on the side of the base end 61Ae extends away from the base portion 61B in parallel to the first rotation axis L1 and curves around the first rotation axis L1 as a center thereof in cross section. The portion on the side of the tip edge 61At curves and tapers toward the tip edge 61At starting from a middle of the main portion 61A. In the above configuration, the belt holding member 60 can be attached to the fixing belt 10 in a manner to gradually increase an inner periphery of the first rim 101 of the fixing belt 10. Thus, breakage of the fixing belt 10 can be further effectively prevented.

Furthermore, the tip edge 61At of the first holding member 61 is separate from the inner circumferential surface 104 of the fixing belt 10. Specifically, a top area 61Tp of the tip edge 61At is separate from the inner circumferential surface 104 of the fixing belt 10. In the above configuration, breakage of the fixing belt 10 caused by thrust contact of a corner edge of the tip edge 61At of the first holding member 61 with the inner circumferential surface 104 of the fixing belt 10 can be further effectively prevented.

Figure 7C:
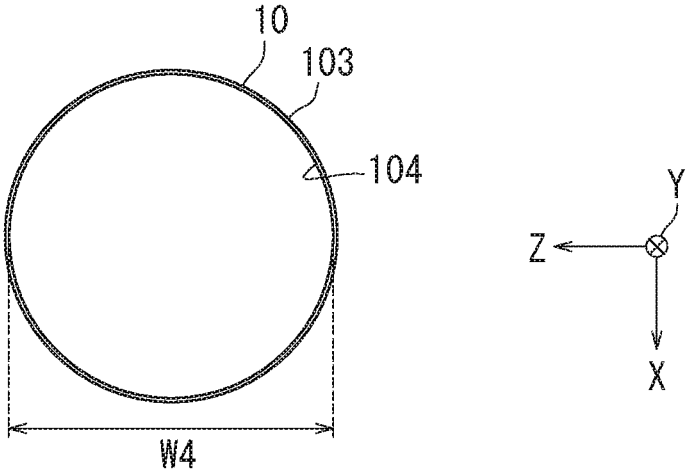
FIG. 7C is a plan view of the fixing belt in the embodiment.

FIG. 7C is a plan view of the fixing belt 10 when the fixing belt 10 is in a substantial circular shape in cross section. In the configuration in which the first width W1 of the heater 31 in the short direction of the heater 31 is larger than the second width W2 of the fixing nip area RN in the short direction of the fixing nip area RN (see FIG. 4) as described above, it is probable in some cases that a maximum outer diameter W3 of the first holding member 61 is larger than the inner diameter W4 of the fixing belt 10 when the fixing belt 10 is in a circular shape in cross section. As such, the third distance D3 that is the inner diameter W4 of the fixing belt 10 in the direction of the Z axis is made substantially equal to the second distance D2 between the outer peripheral extremities 321BE of the main body portions 321B in a pair through insertion of the heating section 30 in the fixing belt 10. In the above configuration, the first holding member 61 can be attached to the first rim 101 of the fixing belt 10 without pressing and deforming the fixing belt 10. Accordingly, a burden on an operator in assembling the fixing device 1 can be reduced. Consequently, breakage of the fixing belt 10 caused by deformation of the fixing belt 10 can be prevented.

Figure 8A:
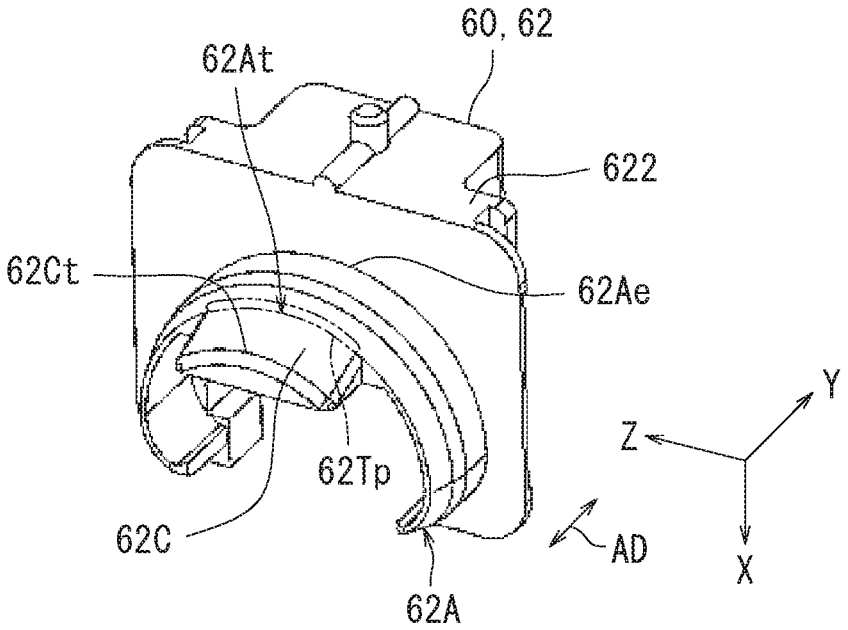
FIG. 8A is a perspective view of a second holding member in the embodiment.
Figure 8B:
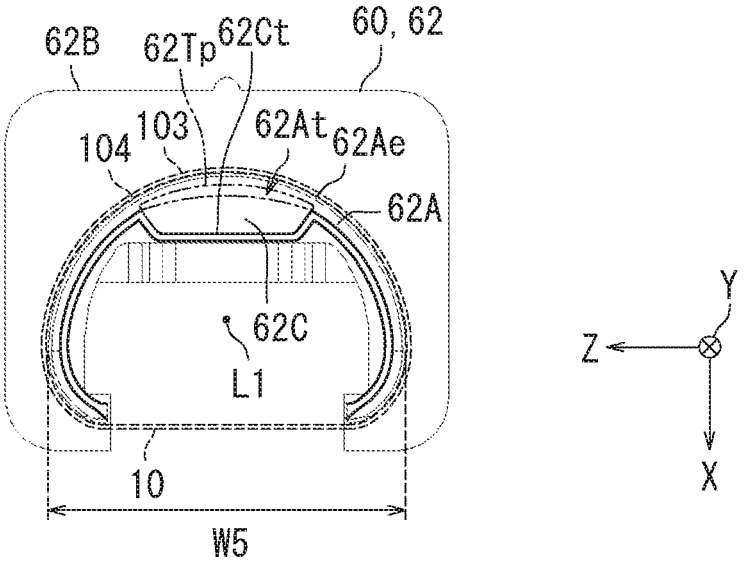
FIG. 8B is a plan view of the second holding member in the embodiment.

The second holding member 62 in the present embodiment will be described next with reference to FIGS. 8A to 10. FIG. 8A is a perspective view of the second holding member 62 in the present embodiment. FIG. 8B is a plan view of the second holding member 62 attached to the fixing belt 10. The fixing belt 10 is indicated by broken lines in FIG. 8B for the sake of explanation. Note that the second holding member 62 is attached to the fixing belt 10 after the first holding member 61 is inserted in the fixing belt 10.

As illustrated in FIGS. 8A and 8B, the second holding member 62 includes a main portion 62A, a base portion 62B, and a protrusion 62C. The main portion 62A protrudes from the base portion 62B in a direction parallel to the first rotation axis L1. The main portion 62A has an outer circumferential surface with a C-shape in cross section when viewed in a direction parallel to the first rotation axis L1. That is, the outer circumferential surface of the main portion 62A has the same shape as the outer circumferential surface of the main portion 61A of the first holding member 61. The protrusion 62C protrudes away from the base portion 62B from a tip edge 62At of the main portion 62A. The second holding member 62 is attached to the second rim 102 of the fixing belt 10. In the above configuration, the main portion 62A can be inserted inside the fixing belt 10 once the protrusion 62C is inserted inside the fixing belt 10 in attaching the second holding member 62 to the fixing belt 10. That is, the protrusion 62C can function as a guide for attachment of the second holding member 62 to the fixing belt 10. Accordingly, a burden on the operator in assembling the fixing device 1 can be reduced.

The tip edge 62At and the protrusion 62C of the main portion 62A each have an outer circumferential surface that curves along the main portion 62A. That is, the protrusion 62C has a curved surface that tapers toward a tip edge 62Ct thereof. In the above configuration, the second holding member 62 can be attached to the second rim 102 of the fixing belt 10 in a manner to gradually increase an inner periphery of the second rim 102 of the fixing belt 10. Thus, breakage of the fixing belt 10 can be further effectively prevented.

In addition, the curved surface of the protrusion 62C curves along the main portion 62A. In the above configuration, the corner edge of the tip edge 62Ct of the protrusion 62C does not bite into the inner circumferential surface 104 of the fixing belt 10 in a state in which the second holding member 62 is attached to the second rim 102 of the fixing belt 10. Thus, breakage of the fixing belt 10 can be prevented.

Moreover, a maximum outer diameter W5 of the second holding member 62 is substantially equal to the inner diameter W4 of the fixing belt 10 in the direction of the Z axis when the fixing belt 10 in a non-circular shape in cross section. In the above configuration, the second holding member 62 can be attached to the second rim 102 of the fixing belt 10 without pressing and deforming the fixing belt 10. Accordingly, a burden on the operator in assembling the fixing device 1 can be reduced. Consequently, breakage of the fixing belt 10 caused by deformation of the fixing belt 10 can be prevented.

Figure 9A:
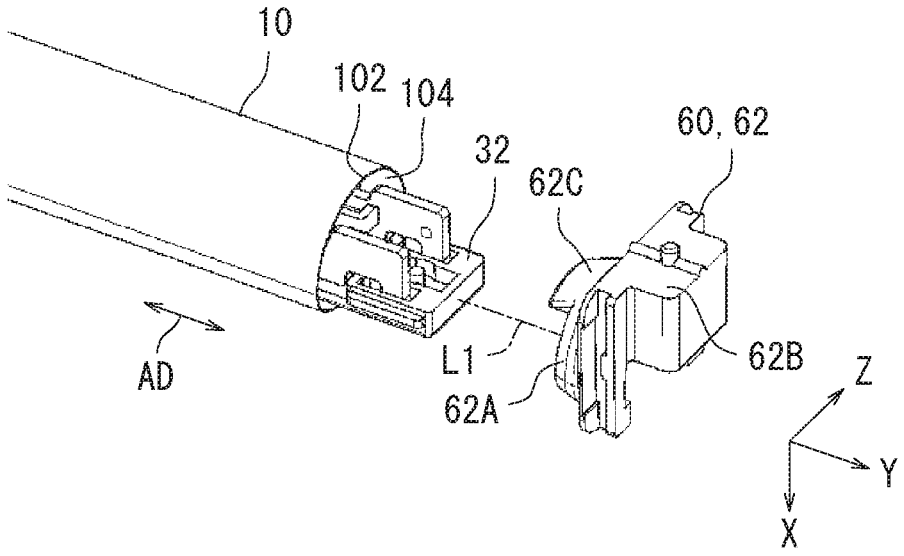
FIG. 9A is a perspective view of the second holding member before being attached to the fixing belt in the embodiment.
Figure 9B:
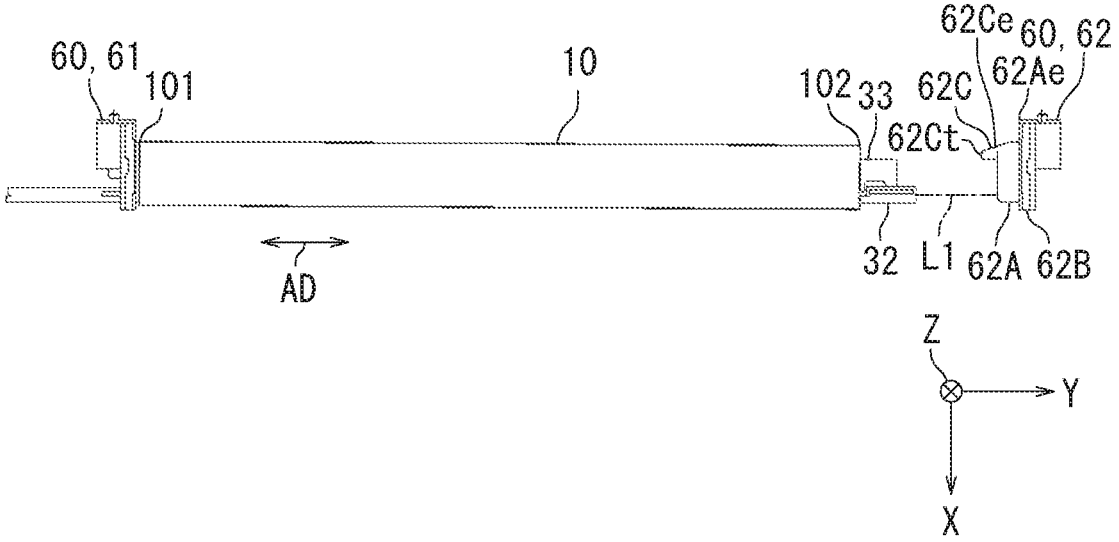
FIG. 9B is a schematic diagram illustrating the second holding member before being attached to the fixing belt in the embodiment.

FIG. 9A is a perspective view of the second holding member 62 before being attached to the fixing belt 10. FIG. 9B is a schematic diagram illustrating the second holding member 62 before being attached to the fixing belt 10. As illustrated in FIGS. 9A and 9B, the second holding member 62 is attached to the fixing belt 10 after the first holding member 61 is attached to the fixing belt 10. Through the first holding member 61 being attached to the fixing belt 10, the first rim 101 of the fixing belt 10 is pulled in the negative direction of the X axis. The fixing belt 10 accordingly inclines relative to the direction of the first rotation axis L1, and the second rim 102 is biased in the direction of the X axis.

The tip edge 62Ct of the protrusion 62C is separate from the inner circumferential surface 104 of the fixing belt 10 more than a base end 62Ce of the protrusion 62C. In addition, the protrusion 62C inclines in a direction away from the inner circumferential surface 104 relative to the first rotation axis L. In the above configuration, the operator can attach the second holding member 62 to the fixing belt 10 in a manner that the shape of the fixing belt 10 is appropriately deformed by pushing the protrusion 62C against an inner upper area of the fixing belt 10. Accordingly, the operator can easily attach the second holding member 62 to the second rim 102 of the fixing belt 10, thereby further reducing a burden on the operator in assembling the fixing device 1.

The protrusion 62C protrudes from a top area of the main portion 62A. In the above configuration, even in a state in which the fixing belt 10 inclines relative to the direction of the first rotation axis L1 in attachment of the second holding member 62 to the fixing belt 10, the protrusion 62C can be inserted inside the fixing belt 10 and then each end of the main portion 62A can be inserted inside the fixing belt 10. Accordingly, the operator can easily attach the second holding member 62 to the second rim 102 of the fixing belt 10, thereby further reducing a burden on the operator in assembling the fixing device 1.

Furthermore, the tip edge 62At of the main portion 62A and the tip edge 62Ct of the protrusion 62C of the second holding member 62 are separate from the inner circumferential surface 104 of the fixing belt 10. In the above configuration, breakage of the fixing belt 10 caused by contact of the tip edge 62At and the tip edge 62Ct of the second holding member 62 with the inner circumferential surface 104 of the fixing belt 10 can be further effectively prevented.

Figure 10:
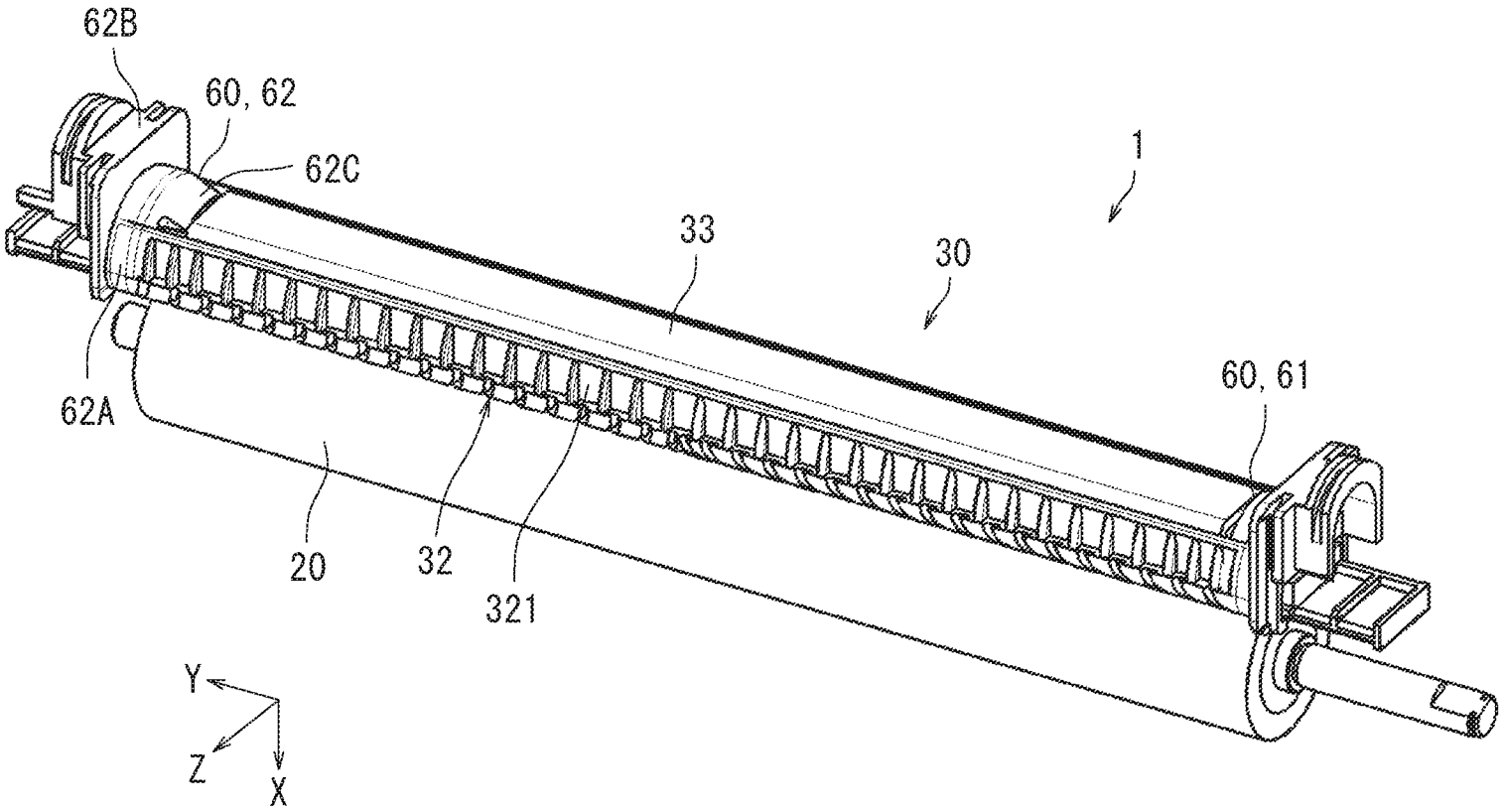
FIG. 10 is a perspective view of the fixing device according to the embodiment.

FIG. 10 is a perspective view of the fixing device 1. The fixing belt 10 is not illustrated in FIG. 10 for the sake of explanation. As illustrated in FIG. 10, the protrusion 62C is spaced apart from the reinforcing member 33. The above configuration can accommodate a dimensional tolerance of each element of the fixing device 1. In particular, a dimensional tolerance of at least one of the second holding member 62 and the reinforcing member 33 can be accommodated.

Figure 11A:
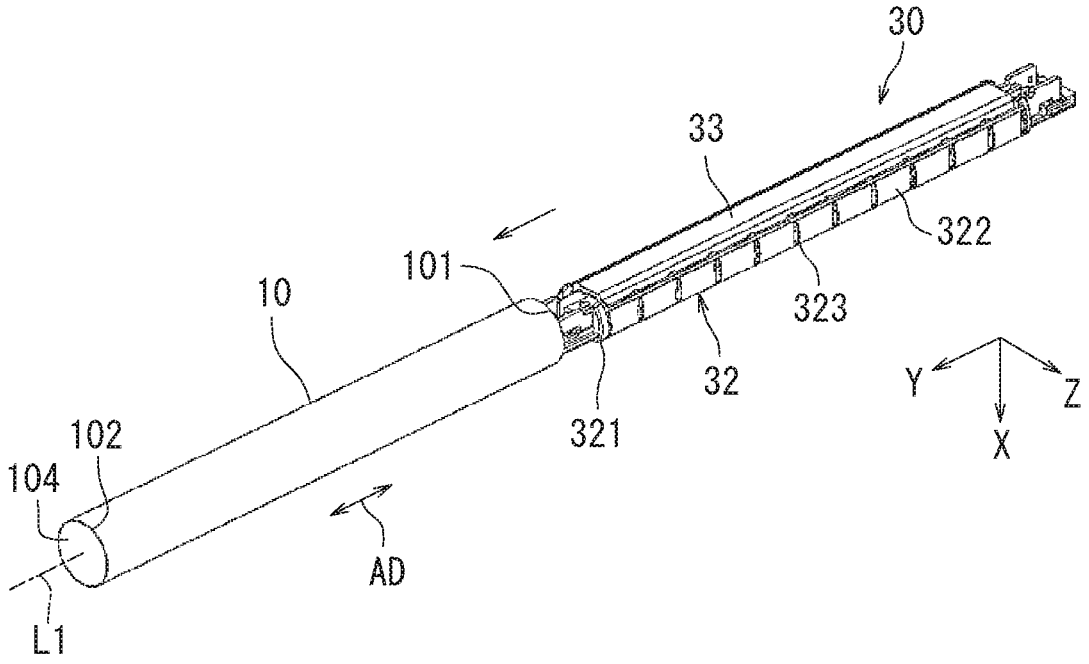
FIG. 11A is a perspective view of the fixing belt before the heating section is inserted therein in the embodiment.
Figure 11B:
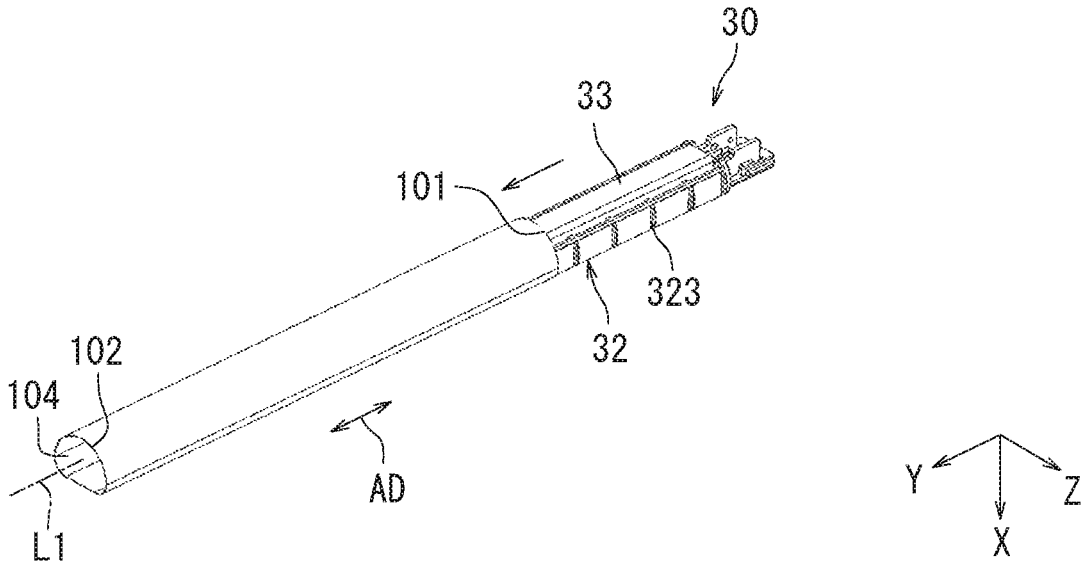
FIG. 11B is a perspective view of the fixing belt in course of the heating section being inserted therein in the embodiment.

Insertion of the heating section 30 into the fixing belt 10 will be described next with reference to FIGS. 11A and 11B. FIG. 11A is a perspective view of the fixing belt 10 before the heating section 30 is inserted therein. FIG. 11B is a perspective view of the fixing belt 10 in course of the heating section 30 being inserted thereinto.

The heating section 30 is inserted into the fixing belt 10 in the following manner. Note that the fixing belt 10 is thin and fragile, and therefore, the heating section 30 cannot be inserted into the fixing belt 10 using a machine. First, the operator presses part of the fixing belt 10 that is a specific distance apart from the first rim 101 using a finger. When the fixing belt 10 is pressed, the first rim 101 of the fixing belt 10 is deformed. Specifically, when the first rim 101 of the fixing belt 10 is pressed in the direction of the X axis, the first rim 101 of the fixing belt 10 is deformed into a substantial oval shape that is long in the direction of the Z axis. When the first rim 101 of the fixing belt 10 deforms into a substantial oval shape, the heating section 30 can be easily inserted into the fixing belt 10 from the first rim 101 of the fixing belt 10.

Next, the operator inserts the heating section 30 into the fixing belt 10 from the first rim 101 of the fixing belt 10. Once the heating section 30 is inserted, the ribs 323 of the main body portions 321B of the heater holding member 32 are in contact with the inner circumferential surface 104 of the fixing belt 10. As a result of being in contact with the inner circumferential surface 104 of the fixing belt 10, the ribs 323 urge the inner circumferential surface 104 of the fixing belt 10. The silhouette of the fixing belt 10 is accordingly defined by the heater holding member 32 as illustrated in FIG. 11B. That is, the shape of the inner circumferential surface 104 of the fixing belt 10 is defined by the heater holding member 32. In the present embodiment, the fixing belt 10 is in a non-circular shape as viewed in the axial direction AD.

After the shape of the inner circumferential surface 104 of the fixing belt 10 is defined by the heater holding member 32, the heating section 30 is then moved from the first rim 101 toward the second rim 102 of the fixing belt 10 to be inserted inside the fixing belt 10. In other words, when the operator moves the heating section 30 in a direction parallel to the axial direction AD, the heating section 30 can be set inside the fixing belt 10. Thus, the operator can insert the remaining part of the heating section 30 into the fixing belt 10 in a stable manner without touching the second rim 102 of the fixing belt 10.

As described above, the widths of the ribs 323 in a direction perpendicular to the axial direction AD are substantially the same as one another in the present embodiment. That is, the ribs 323 protrude from the main surface 321BS of each main body portion 321B to the same height, and therefore, the silhouette of the fixing belt 10 is maintained as being uniform in the width direction thereof.

Figure 12:
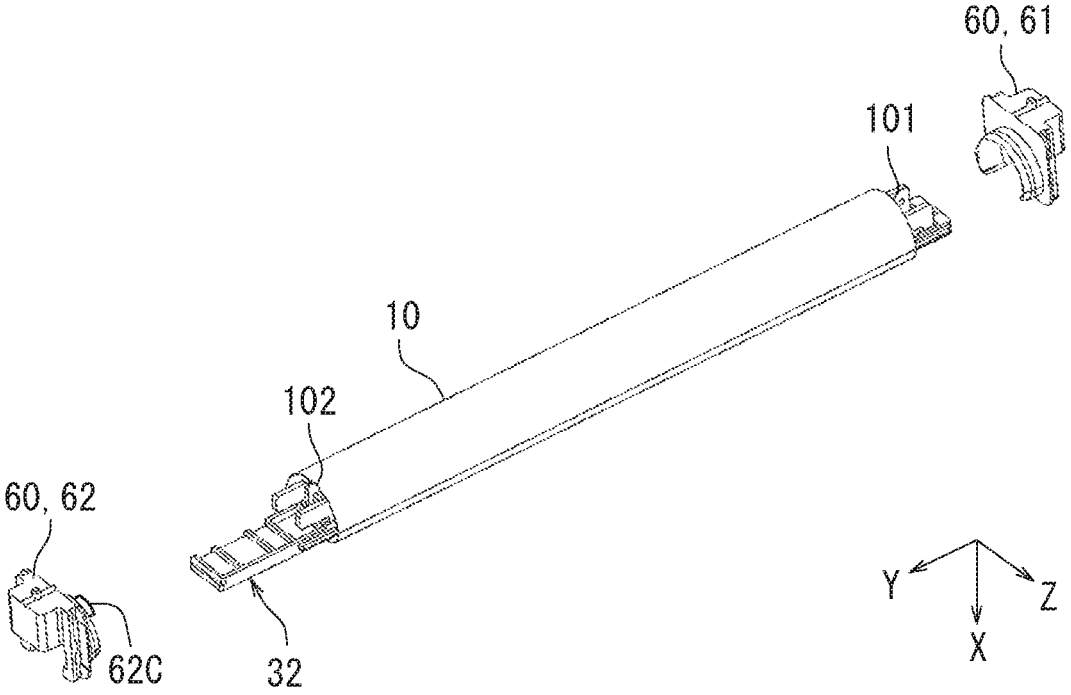
FIG. 12 is a perspective view of the fixing belt before belt holding members are attached thereto in the embodiment.

Attachment of the belt holding members 60 to the fixing belt 10 will next be described with reference to FIG. 12. FIG. 12 is a perspective view of the fixing belt 10 before the belt holding members 60 are attached thereto. The operator first attaches the first holding member 61 to the first rim 101 of the fixing belt 10 while keeping the top area 61Tp of the main portion 61A of the first holding member 61 (see FIG. 7A) in contact with part of the inner circumferential surface 104 of the fixing belt 10 located on a side of the first rim 101 thereof (see FIG. 11B). Next, the operator attaches the second holding member 62 to the second rim 102 of the fixing belt 10 while keeping the top area of the main portion 62A of the second holding member 62 in contact with part of the inner circumferential surface 104 of the fixing belt 10 located on a side of the second rim 102 thereof (see FIG. 11B). Through the above, the operator can attach the belt holding members 60 to the fixing belt 10 without breaking of the fixing belt 10.

An embodiment of the present disclosure has been described so far with reference to FIGS. 1 to 12. However, the present disclosure is not limited to the above-described embodiment and can be practiced in various ways within the scope without departing from the essence of the present disclosure (for example, (1) to (3) described below). The drawings are schematic illustrations that emphasize elements of configuration in order to facilitate understanding thereof, and the thickness, length, number, and so on of each element of configuration illustrated in the drawings may differ from actual ones thereof in order to facilitate preparation of the drawings. The materials, shape, dimension, and so on of each element of configuration shown in the above-described embodiment are merely examples that do not impose any particular limitations and may be altered in various ways, so long as such alterations do not substantially deviate from the effects of the present disclosure.

(1) As described with reference to FIGS. 1 to 9, the image forming apparatus 100 is a monochrome multifunction peripheral in the embodiment of the present disclosure, which should not betaken to limit the present disclosure. The image forming apparatus 100 may be a monochrome printer, for example. Alternatively, the image forming apparatus 100 may be a color multifunction peripheral or a monochrome multifunction peripheral.

(2) As described with reference to FIG. 3, a plurality of urging members 35 are fitted to each of the second covering members 37B. However, two urging members 35 are preferably fixed to each of the second covering members 37B provided that a plurality of urging members 35 are fitted to each of the second covering member 37B. When the reinforcing member 33 turns, the reinforcing member 33 comes into contact with tip edges of the urging members 35. In the above configuration, positional shift of the urging members 35 relative to corresponding heat sensitive bodies 34 can be inhibited in turning of the reinforcing member 33. Thus, precision in sensing the heat of the heater 31 can be improved and assembly of the heating section 30 can be facilitated.

(3) As described with reference to FIG. 6, the outer peripheral extremities 321BE of the main body portions 321B correspond to the outer peripheral extremities of the ribs 323 protruding from the main body portions 321B. However, in a configuration in which the outer peripheral extremities of the ribs 323 protrude more than outer peripheral extremities of the distal ends 321A in the width direction of the fixing belt 10 with respect to the reinforcing member 33, the outer peripheral extremities 321BE correspond to the outer peripheral extremities 321AE of the distal ends 321A.

What is claimed is:

1. A fixing device comprising:

a fixing belt that is endless;

a pressure member configured to press the fixing belt by being in contact with an outer circumferential surface of the fixing belt and rotate about a rotation axis of the pressure member; and a heating section disposed opposite to an inner circumferential surface of the fixing belt, wherein the outer circumferential surface of the fixing belt and an outer circumferential surface of the pressure member are in contact with each other to form a fixing nip area, the heating section includes:

a heater extending in an axial direction thereof that is a rotation axis of the fixing belt, disposed opposite to the fixing nip area while in contact with the inner circumferential surface of the fixing belt, and configured to heat the fixing belt, the rotation axis of the fixing belt being parallel to the rotation axis of the pressure member; and a heater holding member extending in an axial direction thereof that is the rotation axis of the fixing belt, and configured to hold the heater, the rotation axis of the fixing belt being parallel to the rotation axis of the pressure member, the heater holding member includes side walls in a pair and a connecting wall located opposite to the heater, the side walls being opposite to each other in a short direction of the fixing nip area, the connecting wall serving as a connection between the side walls of the heater holding member, the side walls stand from the connecting wall in a direction away from the pressure member, each of the side walls includes a distal end in the axial direction of the heater and a main body portion continuing to the distal end in the axial direction of the heater, the distal ends of the side walls are separate from each other in the short direction of the fixing nip area, each of the distal ends has a tip surface that is a tip edge in the axial direction of the heater, a first distance is shorter than an inner diameter of the fixing belt when the fixing belt is in a circular shape in cross section, the first distance being a distance from an outer peripheral extremity of one of the tip surfaces of the distal ends in the short direction of the fixing nip area to an outer peripheral extremity of the other of the tip surfaces thereof in the short direction of the fixing nip area, a second distance is longer than the inner diameter of the fixing belt when the fixing belt is in the circular shape in cross section, the second distance being a distance from an outer peripheral extremity of the main body portion of one of the side walls in the short direction of the fixing nip area to an outer peripheral extremity of the main body portion of the other of the side walls, and the distal ends of the side walls each curve from a corresponding one of the tip surfaces of the distal ends to a corresponding one of the main body portions.

2. The fixing device according to claim 1, wherein each of the distal ends of the side walls has a curved outer surface as viewed in a direction parallel to the axial direction of a rotation axis of the fixing belt, the rotation axis of the fixing belt being parallel to the rotation axis of the pressure member.

3. The fixing device according to claim 1, wherein the distal ends of the side walls taper toward the respective tip surfaces of the distal ends.

4. The fixing device according to claim 1, wherein a first width of the heater in a short direction of the heater is longer than a second width of the fixing nip area in a short direction of the fixing nip area.

5. An image forming apparatus comprising:

the fixing device according to claim 1; and an image forming section configured to form a toner image on a recording medium, wherein the fixing device fixes the toner image to the recording medium.

6. The fixing device according to claim 1, further comprising:

a first holding member attached to the fixing belt, and configured to hold the first rim of the fixing belt; and a second holding member attached to the fixing belt, and configured to hold the second rim of the fixing belt, wherein the second holding member includes:

a base portion;

a main portion protruding from the base portion; and a protrusion protruding from the main portion in a direction away from the base portion.

7. The fixing device according to claim 6, wherein the main portion of the second holding member has a C-shape in cross section, the main portion of the second holding member in the C-shape has a start point, an end point, and a middle point between the start point to the end point of the C-shape, the start point and the end point being located close to the pressure member, the middle point of the main portion of the second holding member is located far from to the pressure member, and the protrusion of the second holding member protrudes from the middle point of the main portion of the second holding member.

8. The fixing device according to claim 7, wherein the protrusion of the second holding member curves along the main portion of the second holding member.

9. The fixing device according to claim 6, wherein the protrusion of the second holding member is separate from the inner circumferential surface of the fixing belt.

10. The fixing device according to claim 6, wherein the protrusion of the second holding member has a tip edge more separate from the inner circumferential surface of the fixing belt than a base end of the protrusion, and the protrusion inclines in a direction away from the inner circumferential surface of the fixing belt relative to the rotation axis of the fixing belt.

11. The fixing device according to claim 1, wherein the distal ends of the side walls incline and curve in a manner to increase a diameter of the main body portion across the distal ends from the respective tip surfaces of the distal ends.

12. The fixing device according to claim 1, wherein the heater has a flat plate shape.

* * * * *